US005696830A

United States Patent [19]

Chahabadi et al.

[11] Patent Number: 5,696,830

[45] Date of Patent: Dec. 9, 1997

[54] CIRCUIT ARRANGEMENT FOR DERIVING A QUALITY SIGNAL DEPENDENT ON THE QUALITY OF A RECEIVED MULTIPLEX SIGNAL

[75] Inventors: Djahanyar Chahabadi; Matthias Herrmann, both of Hildesheim; Lothar Vogt, Barienrode; Jürgen Kaesser, Diekholzen, all of Germany

[73] Assignee: Robert Bosch GmbH, Stuttgart, Germany

[21] Appl. No.: 522,312

[22] PCT Filed: Mar. 22, 1994

[86] PCT No.: PCT/DE94/00320

§ 371 Date: Aug. 25, 1995

§ 102(e) Date: Aug. 25, 1995

[87] PCT Pub. No.: WO94/22228

PCT Pub. Date: Sep. 29, 1994

[30] Foreign Application Priority Data

Mar. 24, 1993 [DE] Germany ..... 43 09 518.6

[51] Int. Cl.[6] ..... H04H 5/00

[52] U.S. Cl. ..... 381/4; 381/7

[58] Field of Search ..... 381/13, 10, 3, 381/4, 7; 455/226.1, 223, 222, 296; 375/270, 284, 285, 321, 346, 349; 329/304–309; 331/25

[56] References Cited

U.S. PATENT DOCUMENTS

| | | | |
|---|---|---|---|
| 4,630,299 | 12/1986 | Welles, II et al. | 381/4 |
| 5,222,252 | 6/1993 | Kasser | 455/226.1 |
| 5,442,709 | 8/1995 | Vogt et al. | 381/7 |
| 5,483,694 | 1/1996 | Bartels et al. | 455/296 |

*Primary Examiner*—Curtis Kuntz
*Assistant Examiner*—Ping W. Lee
*Attorney, Agent, or Firm*—Michael J. Striker

[57] ABSTRACT

The method for obtaining the quality signal includes multiplying a digital multiplex signal (MPX) by respective reference carrier signals mutually phase shifted by 90° to each other, but otherwise equal, to form a pair of mixed signals (Imr1,Imr2); multiplying the mixed signals (Imr1, Imr2) by respective correction signals (G38*c*,G38*s*) to form a pair of corrected mixed signal (Ims1,Ims2); separately multiplying the digital multiplex signal (MPX) by each of two reference pilot signals mutually shifted in phase by 90° relative to each other to form respective derived signals useful for obtaining said correction signals (G38*c*,G38*s*); adding said corrected mixed signals (Ims1,Ims2) to each other; multiplying said mixed signals (Imr1,Imr2) by the respective correction signals (G38*s*,G38*c*) to form a pair of product signals; subtracting these product signals from each other to form a subtraction result and low-pass filtering the subtraction result to obtain a low-pass-filtered resultant signal from which the quality signal is derived.

7 Claims, 3 Drawing Sheets

CIRCUIT ARRANGEMENT FOR DERIVING A QUALITY SIGNAL DEPENDENT ON THE QUALITY OF A RECEIVED MULTIPLEX SIGNAL

BACKGROUND OF THE INVENTION

The invention relates to a circuit arrangement for deriving a quality signal, dependent on the quality of a received multiplex signal, in a stereo broadcast receiver, the multiplex signal containing a sum signal (L+R) in the base band, a subcarrier modulated with a difference signal (L−R) and a pilot signal having half the frequency of the subcarrier.

In the case of car radios, in particular, the quality of reception can fluctuate strongly—for example, owing to dips in the received field strength, owing to multipath reception or owing to the reception of interference signals. In order to keep the disturbances thereby produced as small as possible, various methods are known for masking these disturbances in the LF signal. Thus, it is possible, for example, in the case of poor reception to attenuate the LF signal temporarily, or to reduce the stereo channel separation. These known measures assume, however, that the signal quality can be determined correctly.

SUMMARY OF THE INVENTION

It is the object of the present invention to specify a circuit arrangement for deriving at least one quality signal dependent on the quality of a received signal.

This object is achieved according to the invention when the multiplex signal in digital form is multiplied by a reference carrier, obtained from a scanning rate generated in the broadcast receiver, in two phase angles mutually shifted by 90°, the mixed signals produced by the multiplication are each multiplied by a correction signal to form corrected mixed signals, the corrected mixed signals are added and fed together with the sum signal to a matrix circuit in order to form stereo audio signals (L, R), the mixed signals are further multiplied by the respective other correction signal, and the products of these multiplications are subtracted from one another and subjected to lowpass filtering.

The circuit arrangement according to the invention permits the detection of audible disturbances and is based on the evaluation of the symmetry of the stereo difference signal at subcarrier frequency. It is essential in this procedure that an undisturbed signal must be symmetrical relative to the carrier because of the double sideband amplitude modulation. In the circuit arrangement according to the invention, this symmetry is guaranteed in the case of an undisturbed signal by means of in-phase feeding of the sidebands to be compared. An asymmetry therefore permits the conclusion that there is a disturbance which is audible in the LF signal.

One feature of the invention contributes to symmetry in the undisturbed case in an advantageous way owing to the fact that to form the correction signals the multiplex signal is multiplied by a reference pilot signal, phase-coupled to the reference carrier, in two phase angles mutually shifted by 90°, the further mixed signals produced are subjected to lowpass filtering, and for the purpose of forming the first correction signal the lowpass-filtered, further mixed signals are squared and subtracted from one another and, for the purpose of forming the second correction signal, are multiplied, by one another and by two.

The effect of a fluctuation, not relevant for the purposes of the circuit arrangement according to the invention, in the amplitude of the pilot signal can be suppressed by providing that the lowpass-filtered, further mixed signals are squared and added for the purpose of forming a signal representing the amplitude of the pilot signal, and that the correction signals are controlled with the aid of the signal representing the amplitude of the pilot signal for the purpose of standardizing their amplitude.

In general, the direction of the asymmetry of the sidebands is not important, and so an absolute value generation is provided downstream of the lowpass filter. This is preferably performed by squaring.

The quality signal derived using the circuit arrangement can by all means be an analog signal, which can assume intermediate values between two limiting values. For many purposes, however, a binary signal can be used. One embodiment of the invention therefore provides that the absolute value formed is compared with a threshold value, and the result of the comparison is output as quality signal.

BRIEF DESCRIPTION OF THE DRAWING

An exemplary embodiment of the invention is represented in the drawing with the aid of a plurality of figures, and explained in more detail in the following description.

DESCRIPTION OF THE PREFERRED EMBODIMENT

Identical parts are provided in the figures with identical reference symbols. The exemplary embodiment and parts thereof are, to be sure, represented as block diagrams. However, this does not mean that the circuit arrangement according to the invention is limited to a realization with the aid of individual circuits corresponding to the blocks. The circuit arrangement according to the invention can, rather, be realized in a particularly advantageous way with the aid of highly integrated circuits. In this case, digital signal processors can be used which, given suitable programming, carry out the processing steps represented in the block diagrams. Together with further circuit arrangements inside an integrated circuit, the circuit arrangement according to the invention can form essential parts of a broadcast receiver.

Figure 1:
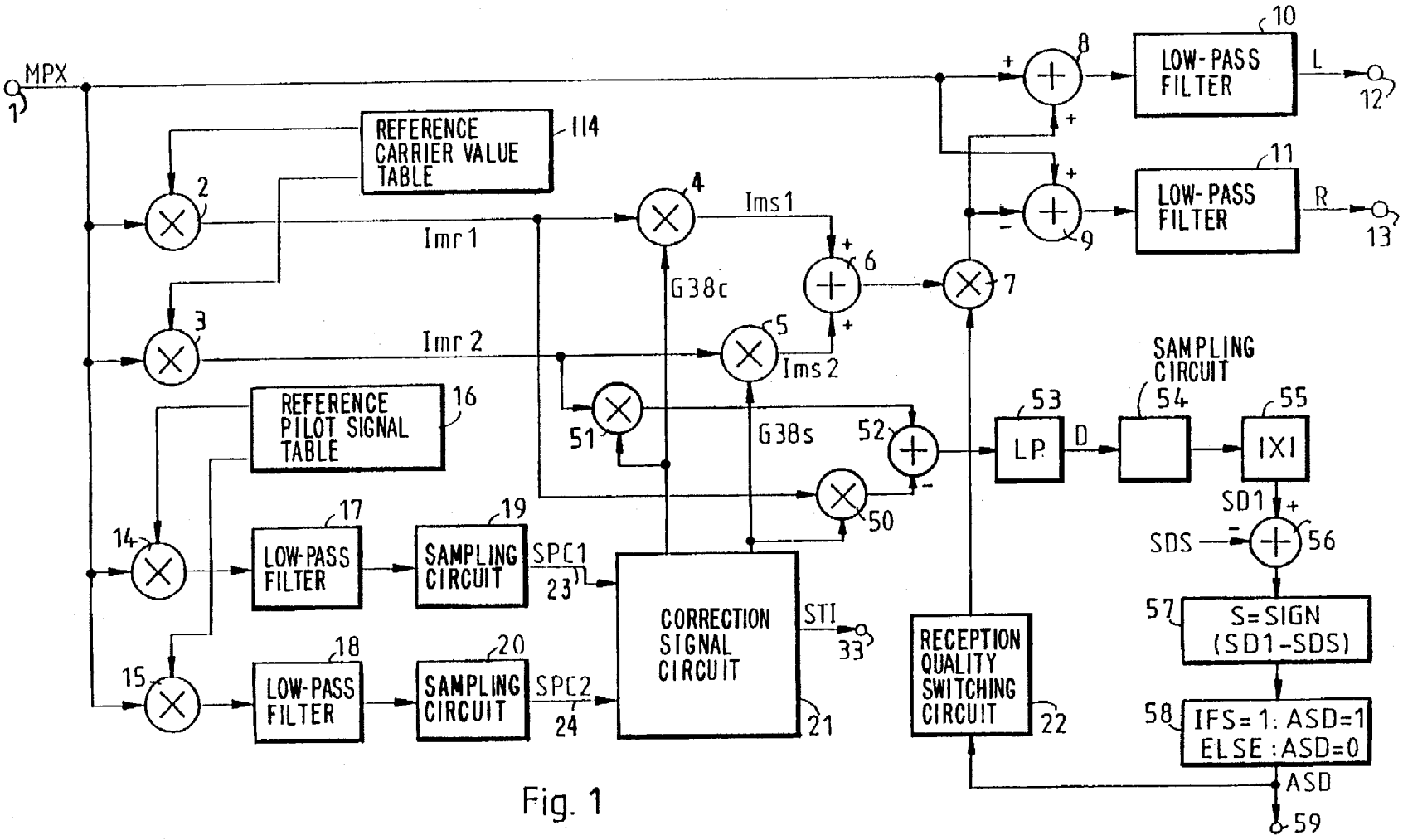
FIG. 1 shows a block diagram of the circuit arrangement according to the invention.

The stereo decoder according to FIG. 1 is fed via an input 1 a digital multiplex signal MPX which contains in a manner known per se a sum signal L+R, a subcarrier modulated with a difference signal L−R, and a pilot signal. In the case of the introduced VHF stereo broadcasting, the frequency of the subcarrier is 38 kHz, while the pilot signal has a frequency of 19 kHz. The angular frequency of the pilot signal is denoted below as $w_p$.

In order to demodulate the carrier-frequency signal, the stereo decoder according to FIG. 1 is provided with multipliers 2, 3, 4, 5 and an adder 6 from whose outputs the demodulated difference signal L−R is fed, via a further multiplier 7, together with the multiplex signal to a matrix circuit consisting of two further adders 8, 9. The decoded digital stereo audio signals L and R pass to outputs 12, 13 via two lowpass filters 10, 11.

The multiplex signal is initially multiplied by a reference carrier with the aid of the multipliers 2, 3, the multiplication in 3 being performed using a reference carrier which is phase-shifted by 90° with respect to the multiplication in 2. The sampled values of the reference carriers are read out from a Table 114. The frequency of the reference carriers is an integral fraction of the sampling frequency on which the multiplex signal is based. The sampling frequency is generated in the broadcast receiver in a manner known per se.

Given an advantageous sampling frequency of 228 kHz, there are six sampled values per period of the reference carriers. The sampled values of the multiplex signal MPX are yielded as $MPX_n := mpx(n \cdot T)$, n being, as also in the case of the variables set forth below, a whole number which denotes the individual sampled values.

The multiplex signal has the following form: $MPX_n = (L_n + R_n) + (L_n - R_n) \cdot \sin(2w_p n \cdot T + 2\alpha) + \sqrt{A} \cdot \sin(w_p n \cdot T + \alpha)$. The following mixed signals are yielded by the multiplication by the values, read out from Table 114, of the reference carrier $\sin(2w_p t)$ and $\cos(2w_p t)$:

$$Imr1 = MPX_n \cdot \sin(2w_p nT) = \tfrac{1}{2}(L_n - R_n) \cdot \cos 2\alpha + \ldots \quad (1)$$

and $$Imr2 = MPX_n \cdot \cos(2w_p nT) = \tfrac{1}{2}(L_n - R_n) \cdot \sin 2\alpha + \ldots \quad (2)$$

In this case, $\alpha$ is the phase difference between the received pilot signal and a reference pilot signal generated from the sampling rate inside the receiver. Terms of higher frequency are not represented in equations (1) and (2), since they are filtered out later by the lowpass filters 10, 11.

The signals Imr1 and Imr2 are fed to further multipliers 4, 5, whose output signals—termed further mixed signals below—can be described as follows:

$$Ims1 = Imr1 \cdot G38c = \tfrac{1}{2}(L_n - R_n) \cdot \cos 2\alpha \cdot G38c_n$$

$$Ims2 = Imr2 \cdot G38s = \tfrac{1}{2}(L_n - R_n) \cdot \sin 2\alpha G38s_n.$$

As is to be described later, $G38s = \sin 2\alpha$ and $G38c = \cos 2\alpha$. The result for the further mixed signals is:

$$Ims1 = \tfrac{1}{2}(L_n - R_n) \cdot \cos 2\alpha \cdot \cos 2\alpha$$

$$Ims2 = \tfrac{1}{2}(L_n - R_n) \cdot \sin 2\alpha \sin 2\alpha.$$

Consequently, the output signal of the adder 6 becomes $\tfrac{1}{2}(L_n - R_n) \cdot (L_n - R_n)$ then results by a suitable standardization using a supplied value D=2 with the aid of the multiplier 7. D can further be used for the purpose of continuously crossfading the channel separation from mono to stereo reception. D=0 for mono operation.

The downstream matrix circuit composed of the adders 8, 9 and the lowpass filters 10, 11 then generates the digital output signals L and R, respectively. The low-pass filters can also be designed advantageously in such a way that apart from the suppression of the frequencies above the useful signal the de-emphasis is carried out.

Figure 2:
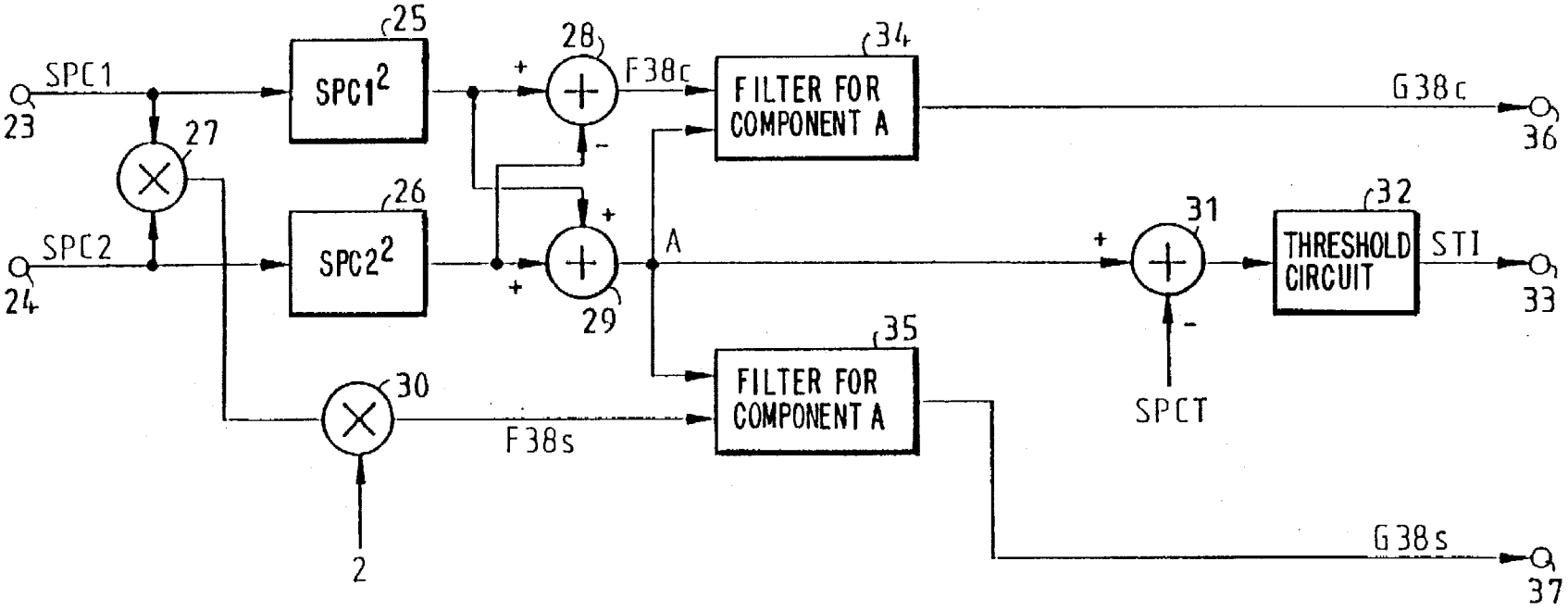
FIG. 2 shows a block diagram of a part, represented only diagrammatically in FIG. 1, of a circuit arrangement for deriving the correction signals.

The first step below is to use FIG. 1 to explain the generation of the correction signals G38*c* and G38*s* fed to the multipliers 4 and 5. For this purpose, the multiplex signal MPX is firstly multiplied by two reference pilot signals $\sin(w_p t)$ and $\cos(w_p t)$, mutually phase-shifted by 90° C., which are read out from a Table 16. The output signals of the multipliers 14, 15 are led via lowpass filters 17, 18 which output signals $SPC1_n = \sqrt{A} \cdot \cos \alpha$ and $SPC2_n = \sqrt{A} \cdot \sin \alpha$. Because of the fact that the frequency of these signals is very much lower by comparison with the pilot signal, there is a reduction in the sampling rate in 19, 20. Consequently, a substantial outlay can be economized in network 21. The output signals of these circuits are fed to network 21, with the aid of which the correction signals G38*s* and G38*c* are derived. Network 21 is described more accurately with the aid of FIGS. 2 and 3 before describing the further parts of FIG. 1.

The signals SPC1 and SPC2 fed via the inputs 23, 24 are respectively squared in 25, 26 and multiplied by one another in 27. The squared signals SPC1 and SPC2 are subtracted from one another in 28 and added in 29. The product of the two signals is multiplied by "2" in 30, thus producing altogether the following signals:

$$A = (SPC1)^2 + (SPC2)^2$$

$$F38c = (SPC1)^2 - (SPC2)^2 = A \cdot \cos 2\alpha$$

$$F38s = 2 \cdot (SPC1 \cdot SPC2) = A \cdot \sin 2\alpha$$

The variable A characterizes the amplitude of the received pilot signal and is converted with the aid of a subtractor 31 and a threshold circuit 32 into a switching signal STI, which can be tapped at an output 33 and used to display the stereo reception.

Signals F38*c* and F38*s* are freed from the component A with the aid of filters 34 and 35, to which the signal A is also fed, thus eliminating the influence of fluctuations in the amplitude of the pilot signal on the stereo decoding. The signals G38*c* and G38*s* freed from the component A can be tapped at the outputs 36, 37 and fed to the multipliers 4, 5 (FIG. 1).

Figure 3:
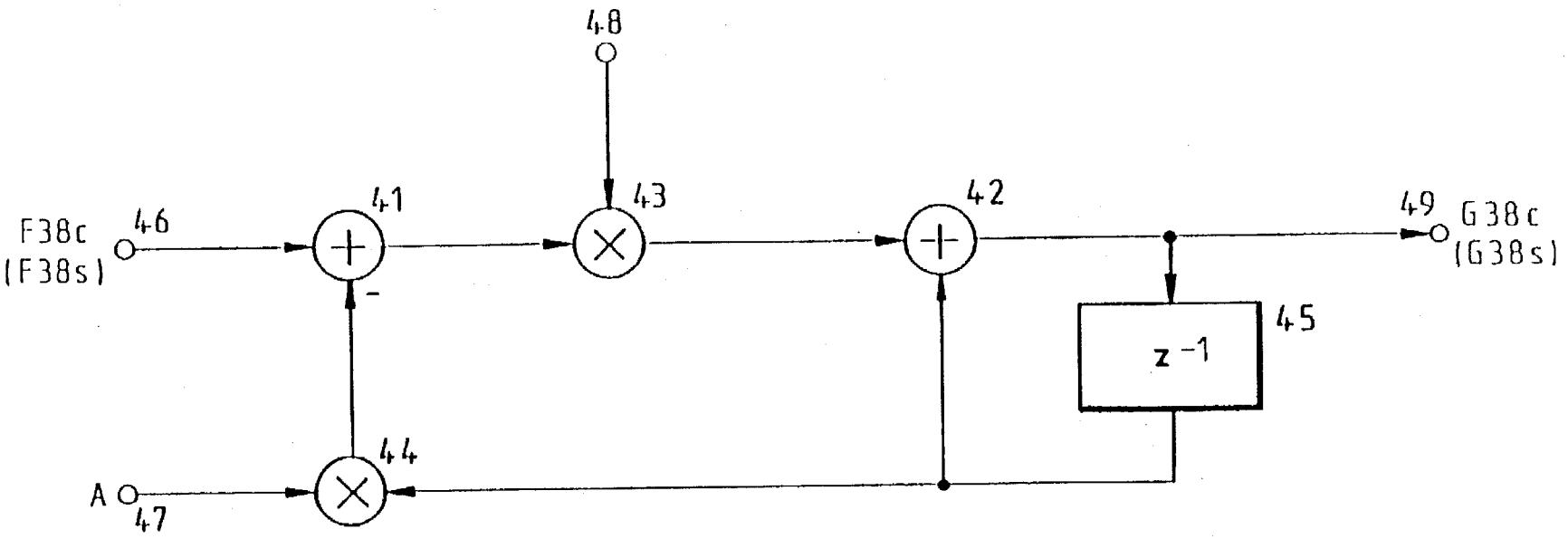
FIG. 3 shows a block diagram of a filter used in the circuit arrangement according to FIG. 2.

An exemplary embodiment for the filters 34, 35 is represented in FIG. 3. It comprises two adders 41, 42, two multipliers 43, 44 and a time-delay element 45. Inputs 46, 47, 48 are fed the signals F38*c* and A as well as a real number $\mu$ by means of which the step size can be controlled. The signal at the output 49 of the filter according to FIG. 3 is then yielded as $G38c_n = G38c_{n-1} + \mu(F38c_n - A \cdot G38c_{n-1})$ and $G38s_n = G38s_{n-1} + \mu(F38s_n - A \cdot G38s_{n-1})$.

After a rise or transient time, $G38c_n = \cos 2\alpha$ or, in the case of the filter 35 (FIG. 2), $G38s_n = \sin 2\alpha$. The number $\mu$ can be permanently prescribed. However, it is also possible to vary the number $\mu$ and thus the rise or transient time, for example immediately after resetting a transmitter, to use a short rise or transient time in accordance with a high bandwidth of the filter, which is then reduced to a lesser bandwidth for the purpose of improving the signal-to-noise ratio.

The parts 50 to 59 of the circuit arrangement according to FIG. 1 represent a symmetry detector whose function is based on the fact that given multiplication of the stereo multiplex signal by a reference carrier which is situated in quadrature relative to the carrier of the stereo difference signal, no output signal is produced in the case of sidebands having amplitudes of the same height. Such a signal is produced in any case in stereo decoders with quadrature demodulation of the carrier-frequency stereo difference signal in which multiplication is performed using two reference carriers, mutually phase-shifted by 90°, and the phase angle relative to the carrier is fixed by a PLL circuit.

When using such stereo decoders, the signal obtained from the demodulation of the quadrature component can be fed directly to a lowpass (LP) filter 53, following which there is a conversion 54 of the sampling rate by the divider 24. This is followed at 55 by an absolute value generation (|X|), whereupon the signal SD1 produced is compared with a threshold value SDS in 56 and 57. In 58, the result of the comparison is evaluated in such a way that the signal ASD at the output 59 has the value 1 when the signal SD1 is greater than the threshold value SDS.

For a stereo decoder in which the subcarrier-frequency stereo difference signal is multiplied by two reference carriers which are mutually phase-shifted by 90° and whose phase angle is not fixed relative to the carrier, the signal processing described below is required upstream of the lowpass filtering in 53. The signal Imr1 is multiplied by the correction signal G38*s*. The signal Imr2 is multiplied in 51 by the correction signal G38*c*. The output signals of the multipliers 50, 51 are subtracted from one another in 52 and fed to the lowpass filter 53.

The signal ASD representing the reception quality can be used for the purpose of switching over from stereo to mono reception and, for example, be fed to the multiplier 7 instead of the signal D. However, in order to form the signal D, apart from the symmetry of the side bands of the subcarrier-frequency difference signal, it is possible to use other variables such as, for example, the received field strength measured via the amplitude of the IF signal or spectral components in the multiplex signal above 60 kHz. These criteria can also be combined in a suitable way, as indicated in FIG. 1 in the form of a circuit 22.

We claim:

1. A method for obtaining a quality signal, said quality signal characterizing a quality of a multiplex signal received in a stereo broadcast receiver, wherein the multiplex signal contains a sum signal (L+R) in a base band, a subcarrier modulated with a difference signal (L−R) and a pilot signal having a frequency equal to half a subcarrier frequency, said method comprising the steps of:

a) multiplying (2) a digital multiplex signal (MPX) by a reference carrier signal (14) to form one mixed signal (Imr1);

b) multiplying (3) the digital multiplex signal (MPX) by another reference carrier signal equal to said reference carrier signal used in said multiplying in step a) but mutually phase shifted by 90° to form another mixed signal (Imr2), wherein said reference carrier signals have a frequency depending on a sampling frequency generated in the stereo broadcast receiver;

c) multiplying (4) the one mixed signal (Imr1) by one correction signal (G38*c*) to form one corrected mixed signal (Ims1) and multiplying (5) said another mixed signal (Imr2) by another correction signal (G38*s*) to form another corrected mixed signal (Ims2);

d) separately multiplying the digital multiplex signal (MPX) by each of two reference pilot signals mutually shifted in phase by 90° relative to each other to form respective derived signals useful for obtaining said correction signals (G38*c*, G38*s*);

e) adding (6) said corrected mixed signals (Ims1, Ims2) to each other;

f) multiplying (50) said one mixed signal (Imr1) by said another correction signal (G38*s*) to form a product signal and multiplying (51) said another mixed signal (Imr2) by said one correction signal (G38*c*) to form another product signal;

g) subtracting (52) the product signals produced by the multiplying in step f) from each other to form a subtraction result and low-pass filtering (53) the subtraction result to obtain a low-pass-filtered resultant signal; and h) deriving the quality signal from the low-pass-filtered resultant signal.

2. The method as claimed in claim 1, further comprising low-pass filtering (17, 18) said derived signals obtained by multiplying each of the two reference pilot signals mutually shifted in phase by 90° with the multiplex signal (MPX) to form respective intermediate signals (SPC1, SPC2); squaring (25,26) each of said intermediate signals to form respective squared signals and subtracting the squared signals from each other to form one unnormalized signal (F38*c*) used to form said one correction signal (G38*c*); multiplying both of the intermediate signals together to form a resulting product and doubling the resulting product to form another unnormalized signal (F38*s*) used to form said another correction signal (G38*s*).

3. The method as claimed in claim 2, further comprising adding the squared signals obtained by the squaring of the intermediate signals (SPC1, SPC2) to form an amplitude signal characteristic of a pilot signal amplitude (A).

4. The method as claimed in claim 3, further comprising modifying (34,35) each of said unnormalized signals (F38*c*, F38*s*) with the aid of the amplitude signal (A) to normalize correction signal amplitudes and form said correction signals (G38*c*,G38*s*).

5. The method as claimed in claim 1, wherein the deriving of the quality signal includes generating (55) an absolute value of said low-pass-filtered resultant signal after performing said low-pass filtering.

6. The method as claimed in claim 5, wherein the generating of the absolute value comprises squaring said low-pass-filtered resultant signal.

7. The method as claimed in claim 5, wherein the deriving of the quality signal further comprises comparing the absolute value of said low-pass-filtered resultant signal with a threshold value to obtain said quality signal (ASD).

* * * * *